US005121524A

United States Patent [19]

Mortensen

[11] Patent Number: 5,121,524

[45] Date of Patent: Jun. 16, 1992

[54] CABLE TIE

[75] Inventor: Randy S. Mortensen, Tinley Park, Ill.

[73] Assignee: Panduit Corp., Tinley Park, Ill.

[21] Appl. No.: 692,327

[22] Filed: Apr. 26, 1991

[51] Int. Cl.[5] ..... B65D 63/00

[52] U.S. Cl. ..... 24/16 PB; 24/17 AP

[58] Field of Search ..... 24/16 PB, 17 AP, 17 A, 24/17 B, 16 R, 30.5 P; 248/74.3; 292/321, 322

[56] References Cited

U.S. PATENT DOCUMENTS

| | | | |
|---|---|---|---|
| Re. 31,541 | 3/1984 | Wood | 24/17 AP |
| 3,408,699 | 11/1968 | Reynolds . | |
| 3,556,575 | 1/1971 | Farkas | 24/16 PB |
| 3,875,618 | 4/1975 | Schuplin . | |
| 3,892,011 | 7/1975 | Kohke | 24/16 PB |
| 3,906,593 | 9/1975 | Caveney et al. . | |
| 3,996,646 | 12/1976 | Caveney | 24/16 PB |
| 4,422,217 | 12/1983 | Barrette . | |
| 4,498,507 | 2/1985 | Thompson . | |
| 4,680,834 | 7/1987 | Andre et al. . | |
| 4,766,651 | 8/1988 | Kobayashi et al. | 248/74.3 |
| 4,993,669 | 2/1991 | Dyer . | |

OTHER PUBLICATIONS

Deltec cable ties illustrating promotional materials, Thomas & Betts Corp.

*Primary Examiner*—Victor N. Sakran

*Attorney, Agent, or Firm*—Charles R. Wentzel; Mark D. Hilliard

[57] ABSTRACT

A high strength, low strap insertion force cable tie having a locking head that locks the distal ends of a strap in two strap positioning channels in the head with two metal barbs each carried by a pawl hingedly mounted to a side wall of the head.

17 Claims, 3 Drawing Sheets

CABLE TIE

TECHNICAL FIELD

The present invention relates to cable tie fasteners for securing elongate objects in a bundle and specifically relates to a high strength two piece cable tie.

BACKGROUND ART

Prior two piece cable ties have utilized a strap locking head to secure the distal ends of a separate strap around a plurality of elongate objects to secure the objects in a bundle. Reference may be made to U.S. Pat. No. 4,422,417 and U.S. Pat. No. 4,498,507.

A number of prior cable ties have utilized metal barbs inserted within the frame of the locking head of a cable tie in a position to flex upwardly to allow a strap to be inserted past the metal barb while engaging the strap upon attempted withdrawal to lock the strap to the head. Reference may be made to U.S. Pat. No. 3,408,699. Other methods of mounting a metal pawl such as the floating pawl of U.S. Pat. No. 3,875,618 and the metal pawls of the above '417 and '507 patents have been proposed.

Other types of one piece cable ties have utilized hingedly mounted plastic pawls as strap locking mechanisms. Reference may be made to U.S. Pat. No. 3,906,593. A major goal of cable tie design is to achieve the greatest possible ratio of loop tensile strength to strap insertion force, thus, providing a relatively high strength cable tie that is concomitantly easily secured in place.

Prior metal barbed cable ties provide relatively high loop tensile strength but also require high strap insertion force while prior one piece cable ties require relatively lower strap insertion force but do not provide the greater loop tensile strength desired in certain sizes of cable ties. Thus there is a need for improvement in the art.

SUMMARY OF THE INVENTION

The object of the present invention is to provide a high strength cable tie that requires minimal insertion force.

In general a cable tie includes a planar strap and a locking head including a frame defining a strap positioning channel and a strap locking means disposed adjacent the channel for allowing entry of an end of the strap into the channel in a first direction and for preventing withdrawal of the end of the strap in a second direction, wherein the strap locking means includes a pawl hingedly mounted to the frame by a reduced cross section hinge and a metal barb mounted in the pawl and disposed to engage the strap when positioned in the channel and prevent withdrawal of the strap from the head.

DESCRIPTION OF THE PREFERRED EMBODIMENT

Figure 1:
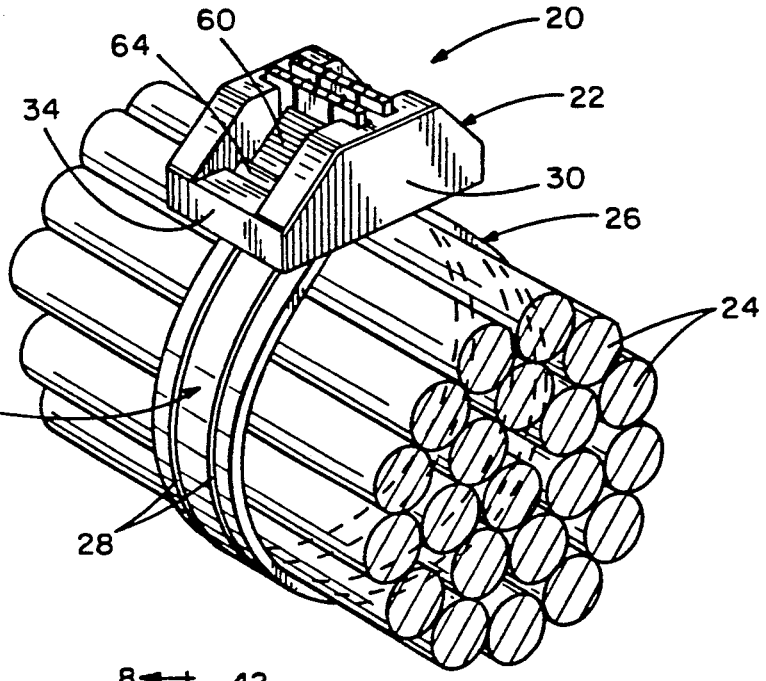
FIG. 1 is an isometric view of a cable tie embodying the concept of the present invention shown secured around a bundle of wires.
Figure 2:
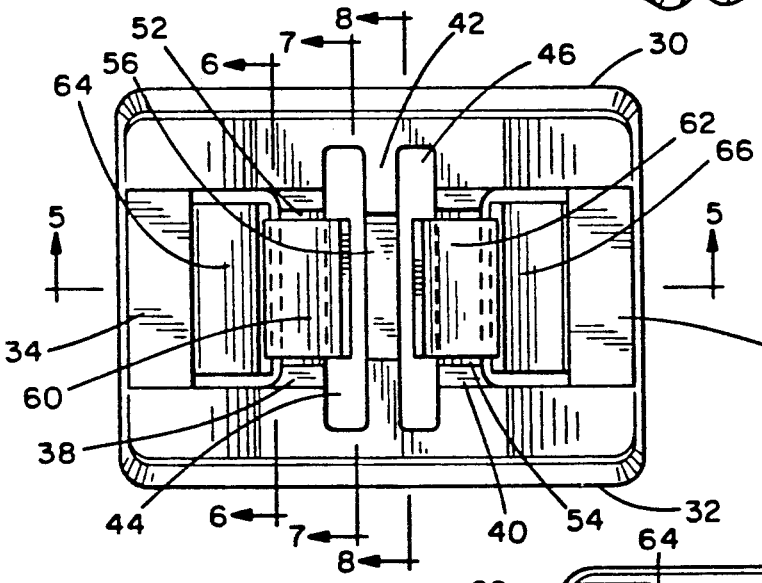
FIG. 2 is a top view of the head of the cable tie of FIG. 1.
Figure 3:
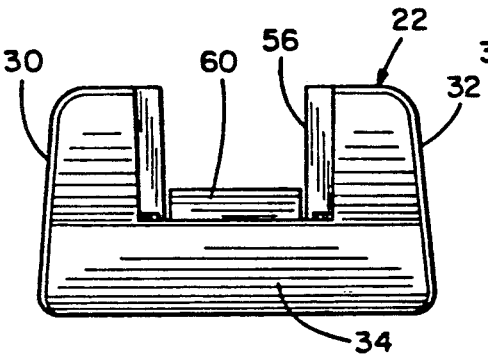
FIG. 3 is an end view of the head of the cable tie of FIG. 1.
Figure 4:
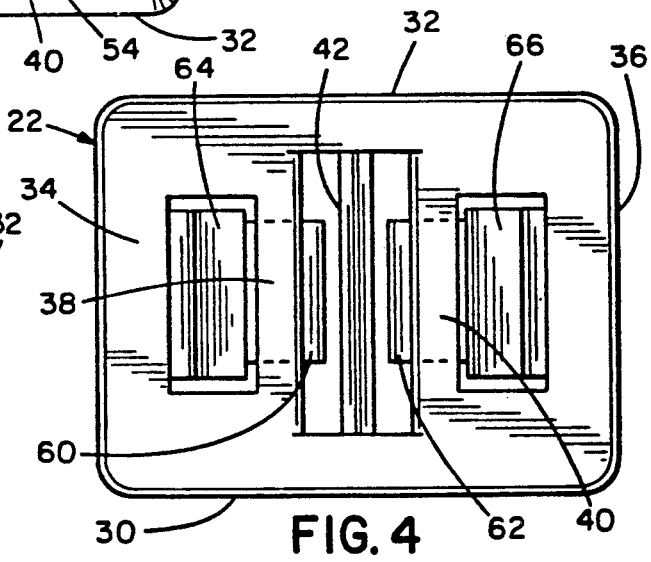
FIG. 4 is a bottom view of the head of the cable tie of FIG. 1.
Figure 6:
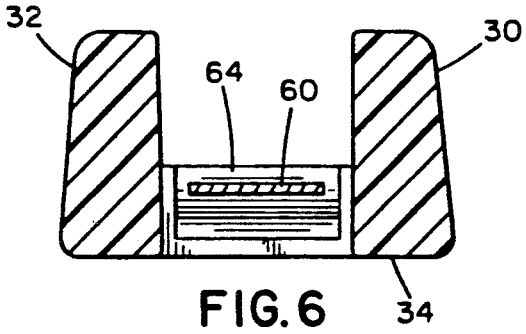
FIG. 6 is a sectional view taken along line 6—6 of FIG. 2.
Figure 7:
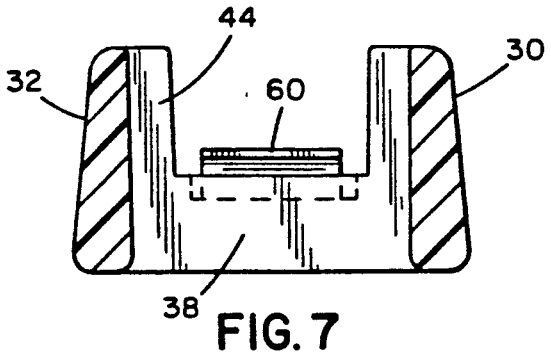
FIG. 7 is a sectional view taken along line 7—7 of FIG. 2.
Figure 8:
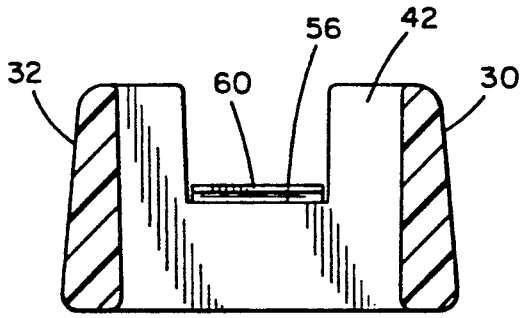
FIG. 8 is a sectional view taken along line 8—8 of FIG. 2.
Figure 9:
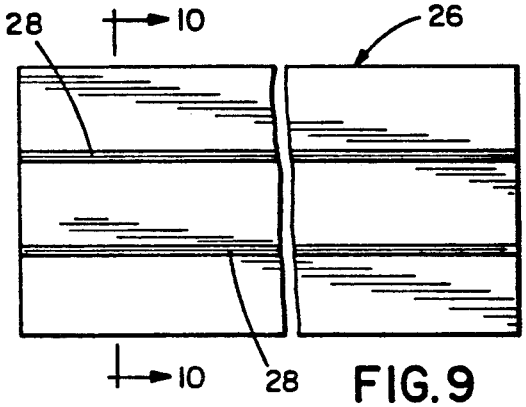
FIG. 9 is a top view of the strap of the cable tie of FIG. 1.
Figure 10:
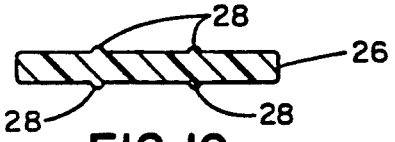
FIG. 10 is a sectional view taken along line 10—10 of FIG. 9.

A two piece cable tie embodying the concept of the present invention is designated generally by the numeral 20 in the accompanying drawings. Cable tie 20 includes a molded locking head 22 and an extruded planar strap 26. Strap 26 is positioned to encompass an object to be secured, such as bundle of wires 24 depicted in FIG. 1, and each end of strap 26 is then locked within head 22 to secure wires 24 within cable tie 20. Molded head 22 is preferably integrally injection molded of a rigid acetal material and strap 26 is preferably extruded of a more flexible acetal material which provides desirable flexibility and weather resistent characteristics to tie 20.

Strap 26 includes two parallel longitudinal ribs 28 formed on each of the opposite widest surfaces of strap 26. In preferred form strap 26 can be provided in a continuous length which can be cut to the desired length before application or can be provided cut to length for specific size bundles. One end of strap 26 could also be integrally molded to head 22 as is well known in the art with the free end of strap 26 being locked within head 22 in the manner taught herein.

Figure 5:
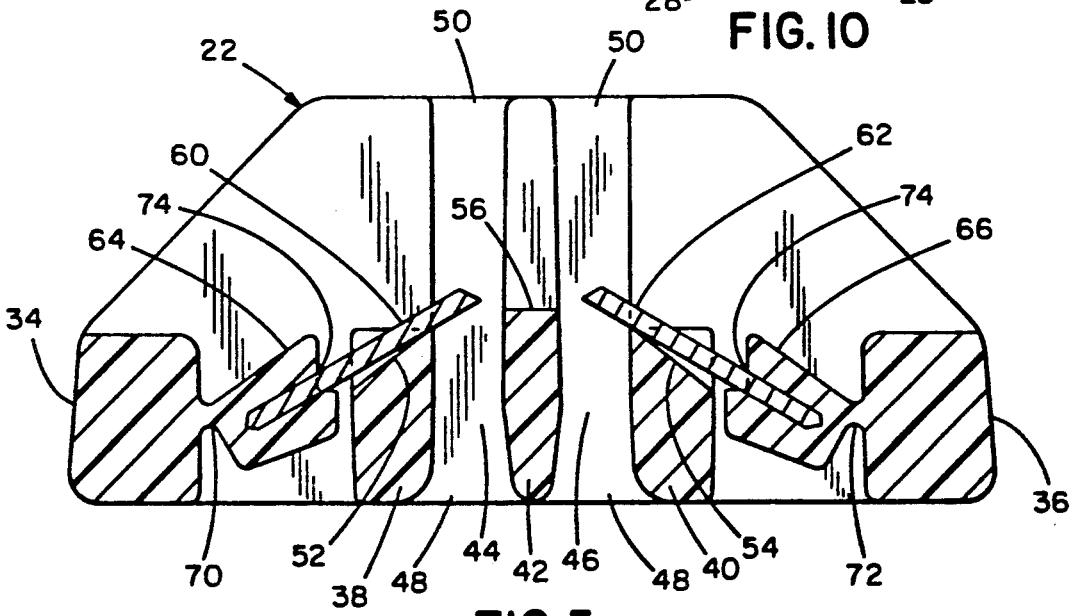
FIG. 5 is a sectional view of the head of the cable tie of FIG. 1 taken along line 5—5 of FIG. 2.
Figure 11:
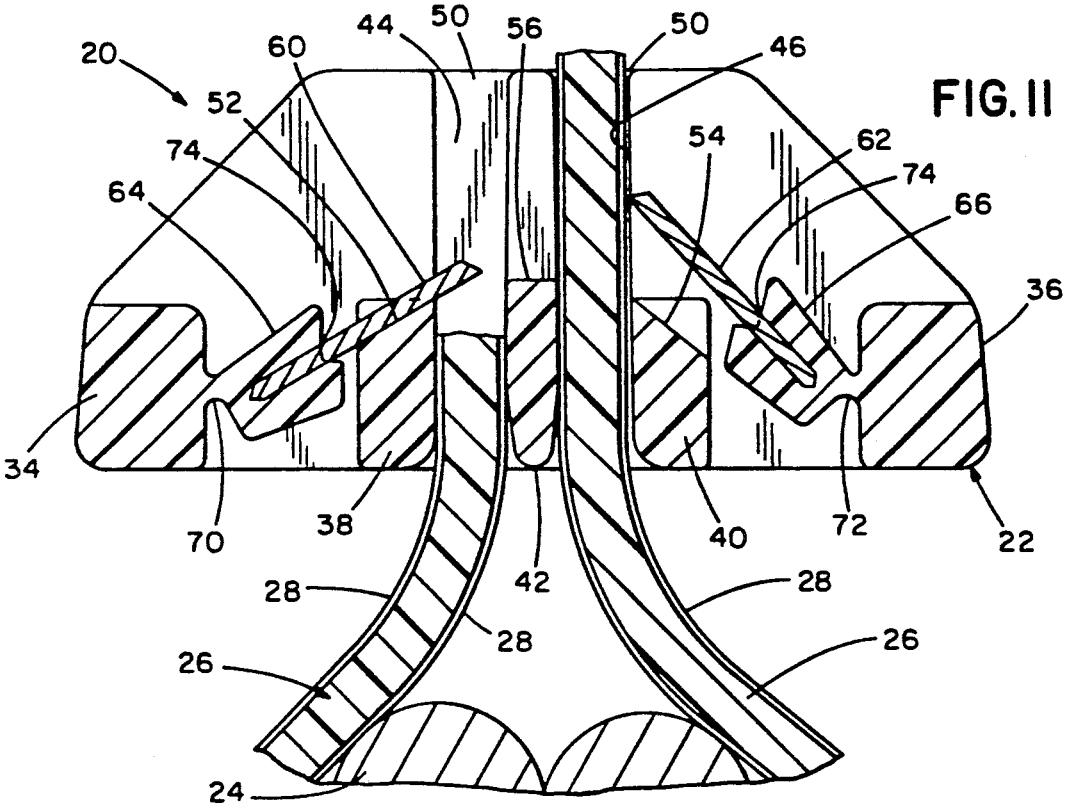
FIG. 11 is a fragmentary sectional view of the cable tie of FIG. 1 showing the strap being inserted into the locking head of the cable tie.

Head 22 includes first and second longitudinal walls 30 and 32, first and second side walls 34 and 36 interposed between and joining longitudinal walls 30 and 32. First and second parallel intermediate walls 38 and 40 are each formed parallel to and between side walls 34 and 36, and perpendicular to and joined to longitudinal walls 30 and 32. A center wall 42 is formed perpendicular and joined to longitudinal walls 30 and 32, between and parallel to intermediate walls 38 and 40 defining therebetween first and second strap positioning channels 44 and 46. Channels 44 and 46 are dimensioned to receive strap 26 first at an entry 48 at the bottom surface of head 22, as best seen in FIG. 5, and position strap 22 until it extends from head 22 at a exit 50 of channels 44 and 46 at the top surface of head 22.

Figure 12:
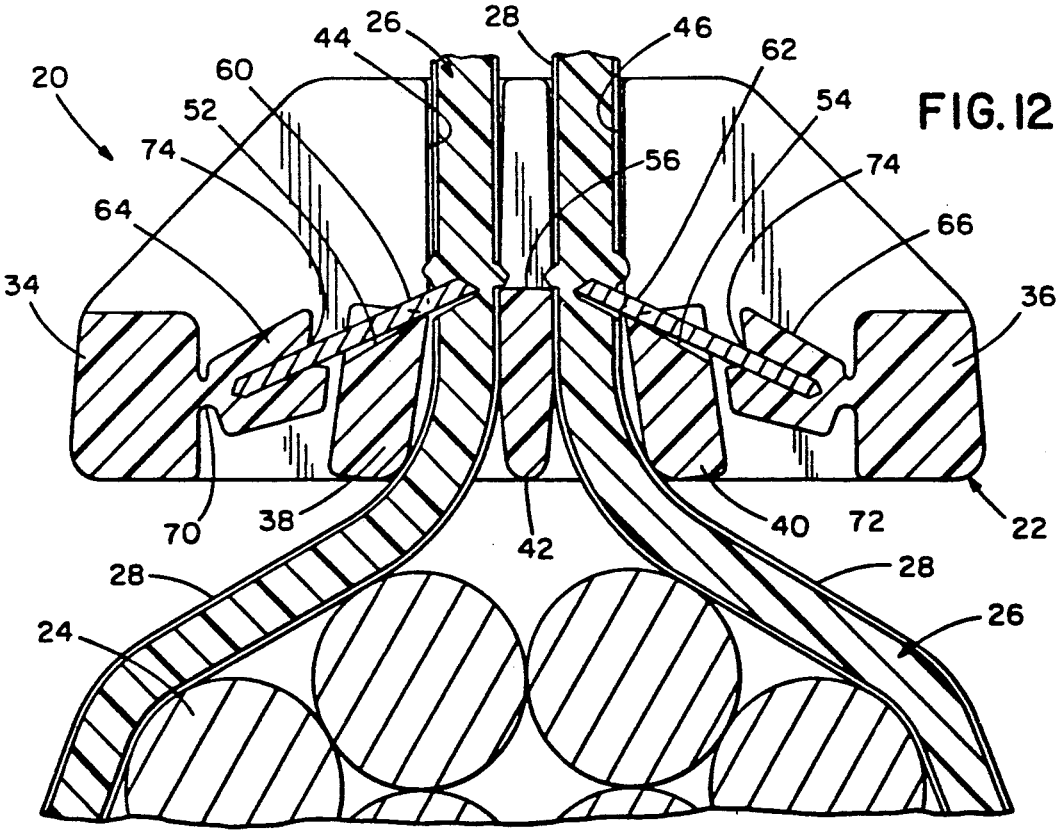
FIG. 12 is a fragmentary sectional view of the cable tie of FIG. 1 showing the cable tie at its applied tension and orientation tightened around a bundle of wires.

Intermediate walls 38 and 40 each include medially disposed first and second barb support surfaces 52 and 54 formed in the exit edges of intermediate walls 38 and 40, support surfaces 52 and 54 being inclined towards center wall 42 and upwardly angled towards exits 50 of channels 44 or 46. A medially disposed notch 56 is formed in the exit edge of center wall 42 which allows insertion of barbs 60 and 62 and facilitates engagement between strap 26 and center wall 42 as best seen in FIG. 12.

First and second metal barbs 60 and 62 are each inserted into and mounted within first and second pawls 64 and 66 which extend from and are connected to the inner faces of respective side walls 34 and 36 by first and second hinge portions 70 and 72 which are areas of reduced cross section that flexibly and pivotally mount each pawl 64 and 66 to respective side walls 34 or 36. Intermediate walls 38 and 40 are disposed transverse to the length of each respective barb 60 or 62 to support each barb 60 or 62.

Each pawl 64 and 66 includes a barb locating notch 74 that positions the distal end of each respective barb 60 or 62 as it is inserted into each pawl 64 or 66.

Ribs 28 of strap 26 are disposed inwardly from the edges of strap 26 in a position to engage the locking barbs 60 or 62 when strap 26 is inserted past barbs 60 or 62 in channels 44 or 46. Strap 26 is of a greater width than the width of barbs 60 or 62.

I claim:

1. A cable tie, comprising:

a planar strap; and a locking head including a frame defining a strap positioning channel and a strap locking means disposed adjacent the channel for allowing entry of an end of the strap into the channel in a first direction and for preventing withdrawal of the end of the strap in a second direction, wherein the strap locking means includes a pawl spaced from the frame which is mounted to the frame by a reduced cross section hinge which pivotally and flexibly mounts the pawl with respect to the frame and a metal barb mounted in the pawl and disposed to engage the strap when positioned in the channel and prevent withdrawal of the strap from the head.

2. A cable tie as set forth in claim 1, wherein the frame includes an intermediate wall means for supporting the barb, the intermediate wall means formed between the pawl and the strap positioning channel.

3. A cable tie as set forth in claim 2, wherein the intermediate wall means includes a barb support surface that is inclined towards an exit of the strap positioning channel and wherein the intermediate wall means is disposed transverse to the length of the barb.

4. A cable tie as set forth in claim 3, wherein the head, pawl and hinge are integrally molded.

5. A cable tie as set forth in claim 4, wherein the pawl includes a barb locating notch formed at a distal end of the pawl.

6. A cable tie as set forth in claim 5, wherein the strap includes a longitudinal rib formed on a planar surface of the strap and positioned to be engaged by the barb.

7. A cable tie as set forth in claim 6, wherein the strap is of a greater width than the barb.

8. A cable tie as set forth in claim 7, wherein the strap is separately formed.

9. A cable tie as set forth in claim 7, wherein the strap and the head are integrally formed with the strap connected to the head at one end.

10. A cable tie as set forth in claim 1, wherein the strap is formed separately from the head and wherein the head includes a second strap locking means and a second strap positioning channel formed in the head adjacent the second strap locking means, the second strap locking means including a second pawl spaced from the frame which is mounted to the frame by a reduced cross section second hinge which pivotally and flexibly mountes the second pawl with respect to the frame and a second metal barb mounted in the second pawl and disposed to engage a second end of the strap when positioned in the second strap positioning channel and prevent withdrawal of the second end of the strap from the head.

11. A cable tie as set forth in claim 10, wherein the frame includes first and second intermediate wall means for supporting respective barbs of the strap locking means and the second strap locking means, each intermediate wall means formed between the pawl and the strap positioning channel of each respective strap locking means, transverse to the length of each respective barb.

12. A cable tie as set forth in claim 11, wherein each of the barbs are disposed to project inwardly towards each other and wherein the frame includes a center wall disposed between and parallel to the intermediate wall means.

13. A cable tie as set forth in claim 12, wherein the intermediate wall means each includes a barb support surface that is inclined towards an exit of the strap positioning channel.

14. A cable tie as set forth in claim 13, wherein each pawl includes a barb locating notch formed at a distal end of each pawl.

15. A cable tie as set forth in claim 14, wherein the strap includes a longitudinal rib formed on a planar surface of the strap and positioned to be engaged by the barb.

16. A cable tie as set forth in claim 15, wherein the strap is of a greater width than the barb.

17. A cable tie as set forth in claim 12, wherein the center wall includes a medially disposed notch formed in an exit edge of the center wall.

* * * * *